US005388082A

United States Patent [19]

Chou

[11] Patent Number: 5,388,082

[45] Date of Patent: Feb. 7, 1995

[54] WATCH CASE BACK OPENER

[75] Inventor: Scott M. S. Chou, Paramus, N.J.

[73] Assignee: Kabushiki Kaisha Hattori Seiko, Tokyo, Japan

[21] Appl. No.: 221,294

[22] Filed: Mar. 31, 1994

[51] Int. Cl.[6] ..... G04B 47/00; G04D 3/00; G04D 1/10

[52] U.S. Cl. ..... 368/327; 81/6; 81/418; 968/684

[58] Field of Search ..... 368/10, 327; 81/6, 7, 81/8, 418, 421; 269/41, 88, 270, 279-284, 285; 968/684

[56] References Cited

U.S. PATENT DOCUMENTS 3,848,484 11/1974 Fried ..... 81/6
3,930,427 1/1976 Addor ..... 81/6
4,121,485 10/1978 Braun et al. ..... 81/6
4,135,416 1/1979 Roux ..... 81/6
4,226,144 10/1980 Pliley ..... 81/6
5,172,895 12/1992 Klimach ..... 269/41

OTHER PUBLICATIONS

Quickly I Advertisement.

*Primary Examiner*—Vit W. Miska
*Attorney, Agent, or Firm*—Stroock & Stroock & Lavan

[57] ABSTRACT

A watch case back opener is provided having a base. A vise is rotatably mounted on the base for securing a watch case to the base. The vise includes a first jaw and a second jaw movable between an open and closed position. Holes are formed in the jaw. They are adapted to receive a plurality of posts to secure a plurality of different sized and shaped watch cases to the vise. An opener unit including an opening blade is mounted on the base for separating a watch case back from the watch case by twisting the lever relative to the base and then lifting the blade relative to the base.

20 Claims, 4 Drawing Sheets

WATCH CASE BACK OPENER

BACKGROUND OF THE INVENTION

This invention is directed to a watch case back opener, and in particular, to a watch case back opener of universal application capable of accommodating a variety of different sized and shaped watch cases having snap type backs.

During watch repairs such as the replacement of a battery, it becomes necessary to open a watch case by removing the back of the watch from the remainder of the watch. In accordance with the prior art, a technician holds the watch in one hand and uses a knife in the other hand to pry open the back to pop watch back away from the remainder of the watch case. This method suffers from many disadvantages including the technician cutting their hand if the knife slips from the watch case. Furthermore, if too much force is applied, the knife will continue into the watch case and damage the elements within the watch case themselves.

A device is also known having a clamp for holding the watch case in position and an opener blade for releasing the watch case back. The watch is manually placed within the clamp in accordance with a best estimate for positioning the watch case relative to the opener blade.

Such a watch case back opener has severe limitations. Prior art watch case openers limit the positioning of the watch and rely to a significant amount on the operator placing the watch correctly within the clamp relative to the opener blade. As a result, misalignment occurs which either will prevent the watch case from being opened, and in some instances will cause damage to the watch case. Additionally, once misalignment is discovered, the watch must be removed and the clamping process restarted resulting in a time consuming trial and error process requiring restarting. Accordingly, a watch case back opener which is able to accommodate a wide variety of different sized and shaped watch cases and allow adjustment of positioning of the watch case and the opener blade in convenient orientation without damaging the watch or technician is desired.

SUMMARY OF THE INVENTION

Generally speaking in accordance with the instant invention, a watch case back opener for separating a watch case back from a watch case is provided. The watch case back opener includes a base. A vise is rotatably mounted on the base. A plurality of holes are provided on each jaw of the vise. A pair of posts adapted to be received in any one of the holes for securing the watch case therebetween are provided on both jaws of the vise. An opener unit is mounted on the base adjacent and slightly above the vise. An opener blade is pivotally mounted on the opener unit to move in one of two directions towards and away from the vise. The opener blade is biasedly mounted relative to the base so that the opener blade is movable between a first position in a plane parallel to the vise and a second position angled relative to the vise.

Accordingly, it is an object the instant invention to provide an improved watch case back opener.

A further object of the invention is to provide a watch case back opener for snap type watches which do not require either the opening blade or the watch case to be held by the hand of the technician.

Another object of the invention is to provide a watch case back opener capable of being adjusted to receive a variety of different sized and shaped watch cases.

Yet another object of the invention is to provide a watch case back opener which allows universal adjustment of positioning of the watch case and the opener blade to accommodate a variety of watch cases designs and sizes.

Still other objects and advantages of the invention will in part be obvious and will in part be apparent from the specification and drawings.

The invention accordingly comprises the features of construction, combination of elements, and arrangement of parts which will be exemplified in the constructions hereinafter set forth, and the scope of the invention will be indicated in the appended claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENTS

Figure 1:
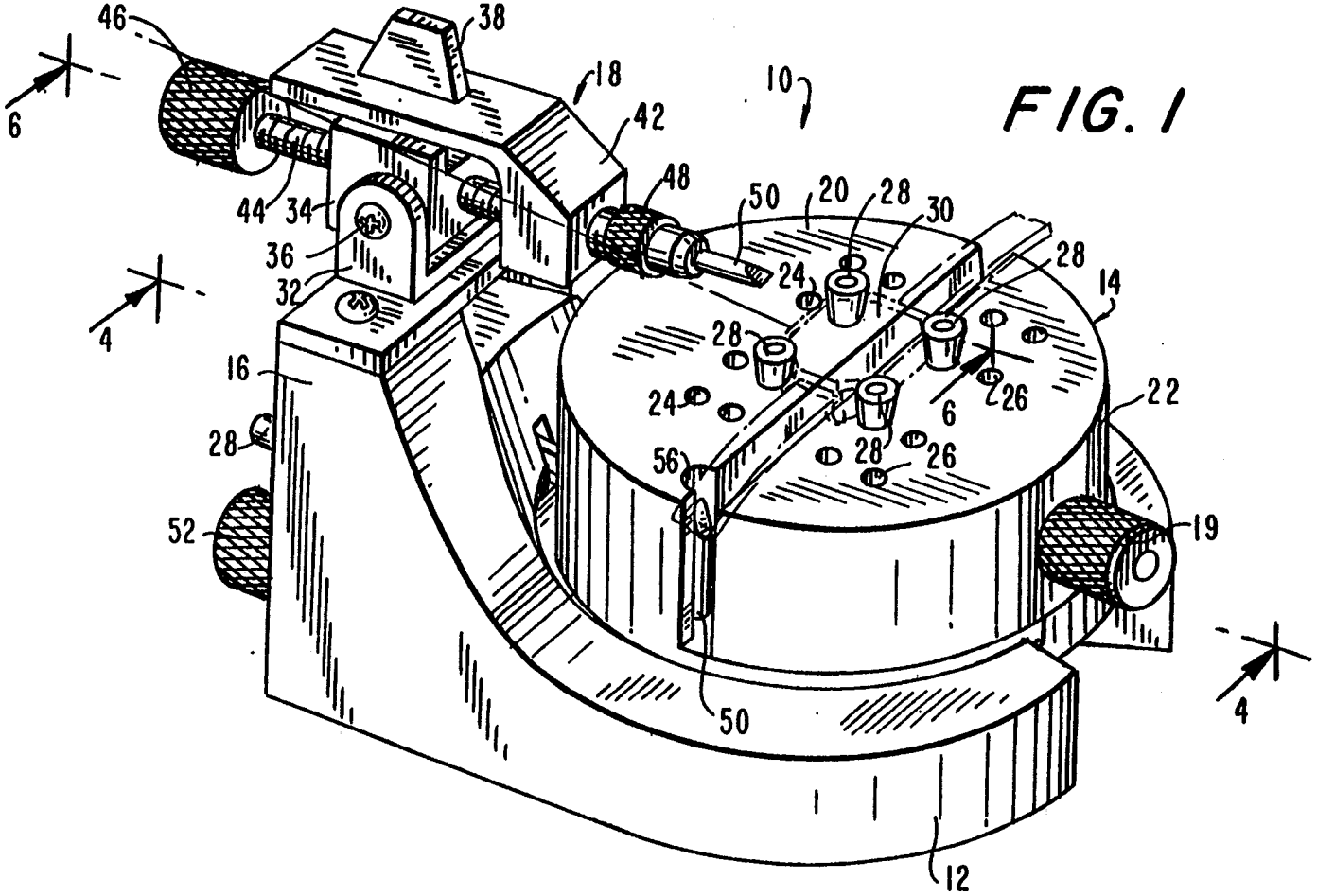
FIG. 1 is a perspective view of a watch case back opener in accordance with the invention.
Figure 3:
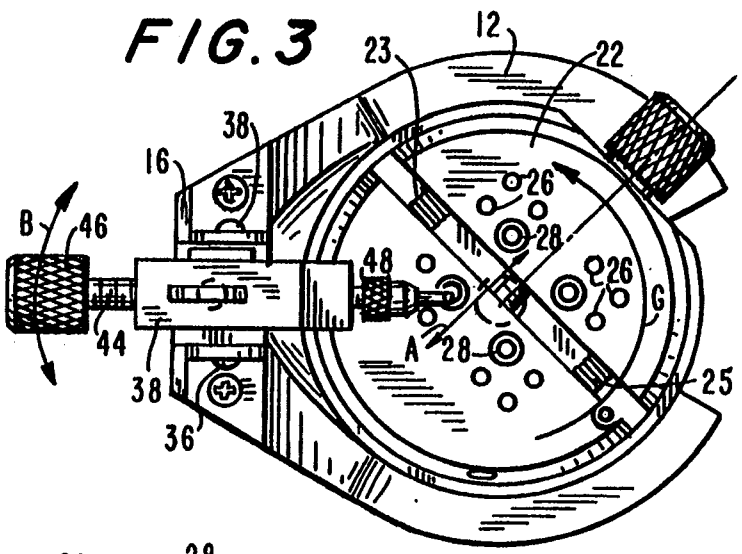
FIG. 3 is a top plan view of the watch case back opener in accordance with the invention in a second rotated position.
Figure 2:
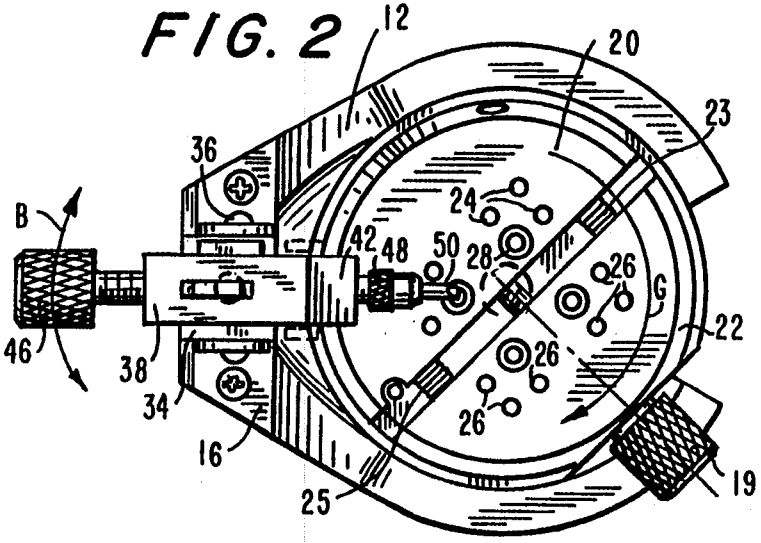
FIG. 2 is a top plan view of the watch case back opener in accordance with the invention in a first rotated position.

Reference is first made to FIG. 1 in which a perspective view of a watch case back opener, generally indicated as 10, constructed in accordance with the invention is provided. Watch case back opener 10 includes a base 12. A vise generally indicated as 14 is rotatably mounted on base 12. Base 12 includes an elevated portion 16. An opener unit 18 is pivotally mounted on elevated portion 16 of base 12.

As further shown in FIGS. 2–5 vise 14 includes a first vise jaw 20. Vise jaw 20 is rotatably mounted within an opening 13 in base 12 about a pivot 15 extending from base 12. A flange 17 formed on jaw 20 and received by base 20 prevents jaw 20 from slipping out from base 12. A second vise jaw 22 is slidably mounted on vise jaw 20 so that vise jaw 22 moves both in a first direction towards and a second direction away from vise jaw 20 in both directions of double headed arrow A.

Figure 4:
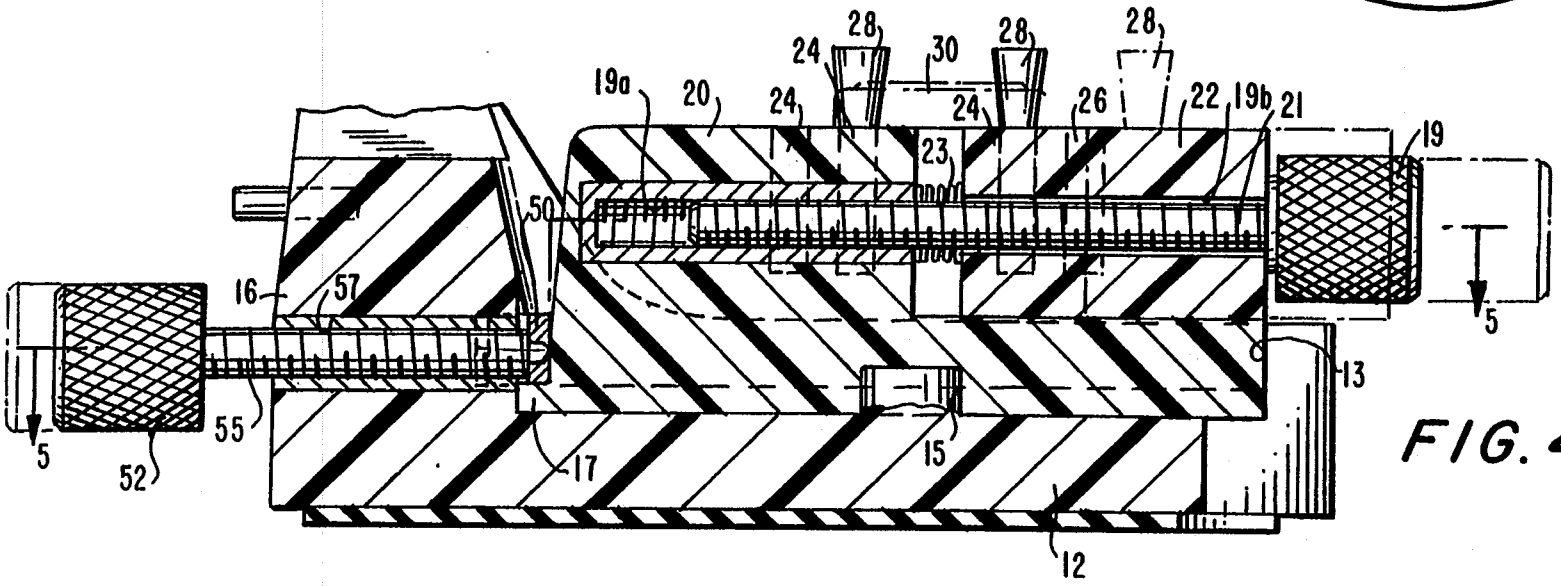
FIG. 4 is a sectional view along line 4—4 of FIG. 1.
Figure 5:
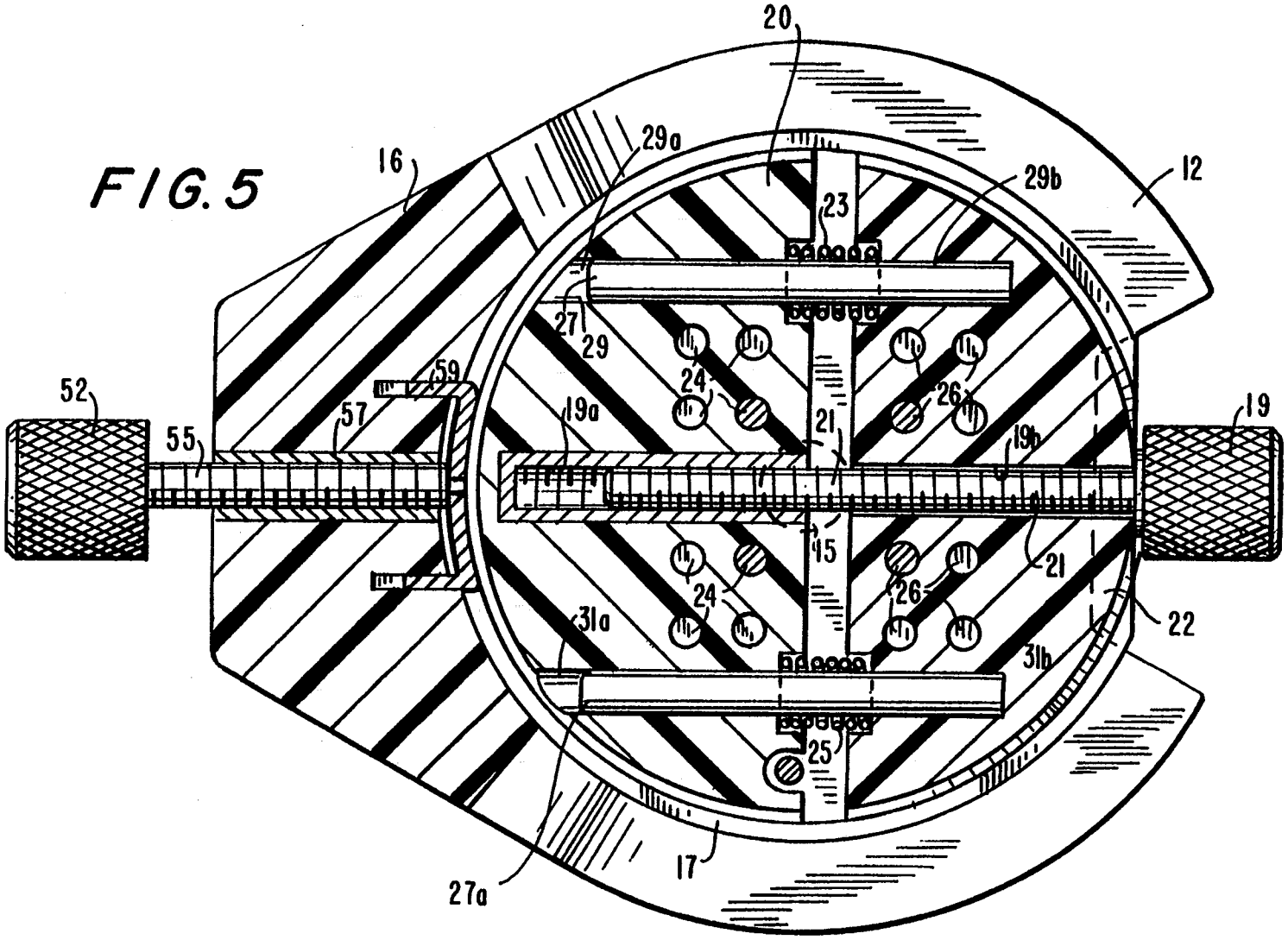
FIG. 5 is a sectional view along line 5—5 of FIG. 4.

As shown in FIG. 4, vise jaw 20 is formed with a threaded channel **19*a*. Vise jaw 22 is formed with a complimentary channel 19*b*. A threaded rod 21 having a knob 19 extends between jaws 20, 22 and is received in channels 19*a*, 19*b* so that turning rod 21 moves jaws 20 and 21 either towards each other or apart from each other depending upon the direction of turning knob 19. Jaw 20 is also formed with slots 29*a*, 31*a* extending substantially parallel with slot 19*a*. Similarly, jaw 22 is formed with slots 29*b*, 31*b* substantially parallel with slot 19*b*. A first rod 27*a* is supported between slots 31*a*, 31*b* and has a first spring 25 is mounted thereabout. Second rod 27*b* is mounted within channels 29*a*, 29*b*** with a second spring 23 mounted thereabout. Springs 23 and 25 are disposed between jaws 20, 22 and bias jaws 20, 22 away from each other. Jaws 20, 22 are held in place by a Blocking action of threaded rod 21 within threaded channel 19*a*. Turning knob 19 causes threaded rod 21 to move further into or out of threaded channel 19*a* causing movement of jaws 20, 22 relative to each other. Rod 27*a* is slidably disposed within channel 31a and moves with jaw 22. Similarly, rod 27*b* is slidably disposed within channel 29*a* and moves with jaw 22.

Vise jaw 20 is formed with a plurality of post holes 24. Similarly, vise jaw 22 is formed with a plurality of post holes 26. Posts 28 sized to be received in either of post holes 24 or post holes 26 are mounted in opposed pairs in post holes 24 and post holes 26, so that at least two posts are provided on each vise jaw.

A watch case 30 (FIG. 6) is positioned on watch case back opener 10 between posts 28 mounted on jaws 20, 22. Post holes 28 are mounted in post holes 24 and 26 to obtain a first approximate fit of watch case 30 and to anchor watch case 30 relative to opener unit 18. Vise jaw 22 is then moved towards vise jaw 20 to provide a force between posts 28 located on the opposed vise jaw to securely maintain watch case 30 on vise 14 to prevent slippage of watch case 30 during the opening operation.

Figure 7:
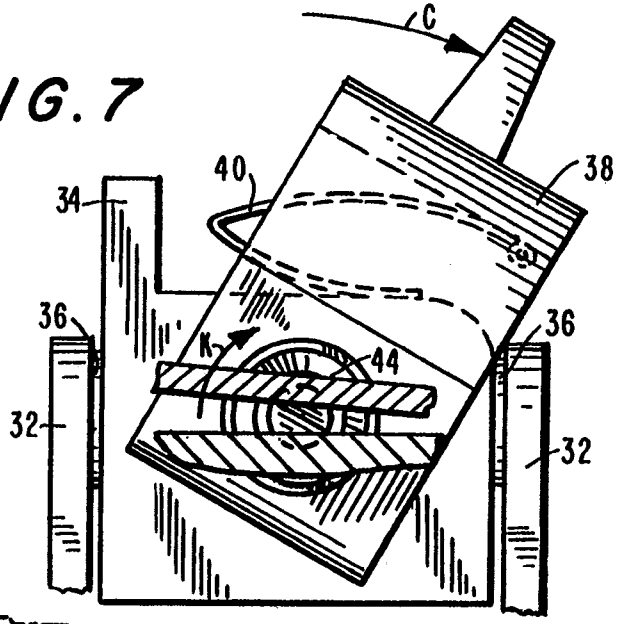
FIG. 7 is a fragmented sectional over view of a twisting lever constructed in accordance with the invention.

Opener unit 18 is mounted above vise 14. Opener unit 18 includes a rotatable mount 32 rotatably mounted on elevated portion 16 of base 12. Rotatable mount 32 rotates in either direction of two headed arrow B. A block 34 is pivotally mounted to mount 32 about a pivot pins 36 on either side of block 34. Block 34 pivots in the direction of arrow B about pivot pins 36. A twisting lever 38 is slidably mounted on block 34 by a spring 40 (FIGS. 6, 7) and a threaded rod 44. Spring 40 biases twisting lever 38 into a position which is substantially parallel to the upper surface of block 34 while allowing movement of twisting lever in the direction of arrow C (FIG. 7) when a force is applied substantially in the direction of arrow C to twisting lever 38.

Threaded rod 44 extends through block 34 and is anchored to a front end 42 of twisting lever 38. A knob 46 is affixed at one end of threaded rod 44. A chuck 48 is affixed to front end 42 so that front end 42 of twisting lever 38 is disposed between chuck 48 and rod 44. Block 34 has a threaded channel 35 through which rod 44 passes so that twisting of knob 46 will cause twisting lever 38 and chuck 48 to either move towards vise 14 or away from vise 14 depending upon the direction of turn of knob 46. Lever 38 slides relative to spring 40 without breaking contact therebetween. An opener blade 50 is releasably mounted in chuck 48.

A knob 52 mounted on base 12 is affixed to a threaded rod 55, which extends through a threaded channel 57 in base 12. A stopper 59 is affixed to rod 55 at the opposed end and comes in contact with vise jaw 20, so that knob 52 when turned causes stopper 54 to frictionally engage vise jaw 20 preventing rotation of vise 14. Turning of knob 52 in an opposite direction releases vice jaw 20. A groove 56 is formed in vise jaw 20 as a storage space for opener blades 50. Spare posts 28 are stored in elevated portion 16 (FIG. 1.)

Figure 6:
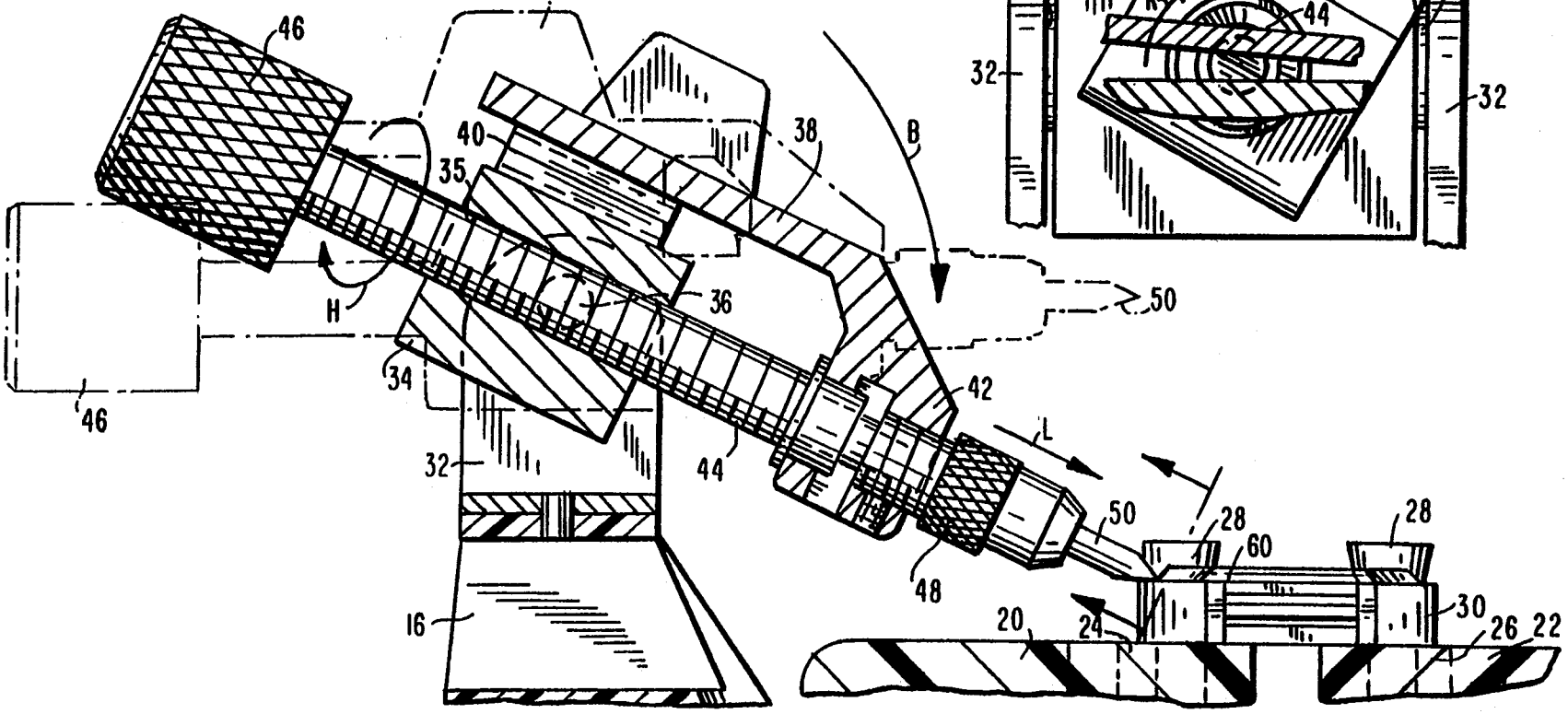
FIG. 6 is a sectional view taken along line 6—6 of FIG. 1.

The majority of watch cases include an opening notch in the watch case on the back surface thereof. During operation of watch case back opener 10, four posts 28 are inserted into post holes 24, 26 in accordance with the approximate size of watch case 30. Knob 19 is then turned to separate vise jaw 20 from vise jaw 22 into an open position. Watch case 30 is placed on vise 14 face down with the case opening notch overlying vise jaw 20 (FIGS. 1, 6). Knob 19 is then turned to close vise 14 tightening posts 24, 28 about watch case 30. Vise 14 is then rotated (FIGS. 2, 3) in either direction of double headed arrow G to align the opening notch with opener blade 50. Once the opening notch has been aligned with opener blade 50, knob 52 is turned to lock vise 14 in the selected position. If there is no opening notch in the back of watch case 30, then the 8 o'clock or 10 o'clock position of the watch face should be aligned with opener blade 50.

Block 34 is now pivoted in the direction of arrow B (FIG. 6) around pivot pin 36 to move opener blade 50 towards vise 14 into a position substantially parallel with the opening notch. Knob 46 is then turned in a direction (Arrow H, FIG. 6) to gradually move opener blade 50 in the direction of Arrow L to come in contact with the opening notch of watch case 30.

In an exemplary embodiment, when used correctly, this should require no more than two full turns. If more than two full turns are required then the watch may be repositioned either by readjusting posts 28 within post holes 24, 26, rotating mount 32, or rotating vise 14, or if necessary further extending opener blade 50 towards the watch case 30 or all three in combination. When opener blade 50 has entered the opening notch, twisting lever 38 is pushed in the direction of arrow C (FIG. 7), rotating twisting lever 38 around rod 44 in the direction of Arrow K, twisting opener blade 50, attached thereto, within the opening notch, prying the caseback 60 from the remainder of watch case 30. Opener unit 18 is then pivoted about pivot pin 36 removing the watch case back from watch case 30. Posts 28 are tapered to prevent watch case 30 from lifting off vise 14 during the opening process.

To change the opener blade 50, chuck 48 is turned counterclockwise to release tension about opener blade 50. A spare opener blade 50 is removed from groove 56 of vise 14. The spare opener blade 50 is then inserted into chuck 48 which is then tightened by turning in a clockwise direction closing the chuck to grip opener blade 50 within the chuck.

By providing posts which may be received by a plurality of post holes on either side of a vise, a single watch case opener may be easily used to accommodate a large number of different sized and shaped watch cases. By providing the post holes in connection with a vise, an anchoring system capable of adjusting widths to further accommodate a large variety of different sized watch cases is provided. By making the vise as a whole rotatable relative to a base, a watch case back opener capable of aligning the opening notch with the opener blade without requiring repositioning of the watch case relative to the vise is provided. Lastly, by providing a twisting lever which allows twisting of the opener blade relative to the opening notch, a simple structure for popping the watch case back is provided.

It will thus be seen that the objects set forth above, among those made apparent from the preceding description, are efficiently attained and since certain changes may be made to the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A watch case back opener comprising:

a base;

vise means mounted on said base for releasably securing a watch case to said base, said vise means including a first jaw and a second comparison jaw, the second jaw being movable between a closed position with said first jaw and an open position away from said first jaw;

adjustable securing means mounted on said first and second jaws adapted to secure a plurality of different sized and shaped watch cases to said vise means; and opener unit means mounted on said base for separating a watch case back from said watch case when said watch case is secured to said vise means.

2. The watch case back opener of claim 1, wherein said adjustable securing means includes a first plurality of holes formed in said first jaw and a second plurality of holes formed on said second jaw, and a plurality of posts, each post adapted to be received within any one of said plurality of holes.

3. The watch case back opener of claim 1, wherein said vise means is rotatably mounted on said base.

4. The watch case back opener of claim 3, further comprising locking means for selectively preventing rotation of said vice means.

5. The watch case back opener of claim 1, wherein said opener unit pivots between a first position adjacent the vise means and a second position away from the vise means.

6. The watch case back opener of claim 1, wherein said opener unit includes an opener blade and further comprising twisting means for twisting said opener blade relative to said base.

7. A watch case back opener comprising:

a base;

vise means rotatably mounted on said base for securing a watch case to said base, said vise means including a first jaw and a second jaw, the second jaw being movable between a closed position with said first jaw and an open position away from said first jaw;

adjustable securing means mounted on said first and second jaw adapted to secure a plurality of different sized and shaped watch cases to said vise means said adjustable securing means including a first plurality of holes formed on said first jaw and a second plurality of holes formed on said second jaw, and a plurality of posts, each post adopted to be received within any one of said plurality of holes; and opener unit means mounted on said base for separating a watch case back from said watch case when said watch case is secured to said vice means said opener unit means pivoting between a first position adjacent the vise means and a second position away from the vise means said opener unit means including an opener blade and twisting means for twisting said opener blade relative to said base.

8. A watch case back opener comprising:

a base;

anchoring means for anchoring said watch case to said base; and opener unit means mounted on said base for separating said watch case back from said watch case, said opener unit means being positioned above said anchoring means and being pivotal between a first position substantially adjacent said watch case secured by said anchoring means and a second position away from said watch case secured by said anchoring means; said opener unit means including an opener blade and twisting means for twisting said opener blade relative to said watch case.

9. The watch case back opener of claim 8, wherein said opener unit includes a block, said block being rotatably mounted on said base and said twisting means includes a twisting lever, said opener blade being supported by said block and said twisting lever, the opener blade moving with said twisting lever and said twisting lever being movable between a first position substantially parallel to a top surface of said block and a second position at an angle to said block causing said opener blade to twist to said angle.

10. The watch case back opener of claim 8, wherein said twisting means further comprises biasing means for biasing said twisting lever into said first position.

11. The watch case back opener of claim 8, wherein said anchoring means includes adjustable securing means adapted to secure a plurality of different sized and shaped watch case to said anchoring means.

12. The watch case back opener of claim 11 wherein said adjustable securing means includes a plurality of holes formed in said anchoring means and a plurality of posts, each post adapted to be received within any one of said plurality of holes.

13. The watch case back opener of claim 8, wherein said anchoring means is rotatable relative to said base.

14. A watch case back opener comprising:

a base;

anchoring means for anchoring said watch case to said base, said anchoring means including adjustable securing means adapted to secure a plurality of different sized and shaped watch case to said anchoring means, said adjustable securing means including a plurality of holes formed in said anchoring means and a plurality of posts, each post adapted to be received in any one of said plurality of holes; and opener unit means mounted on said base for separating said watch case back from said watch case, said opener unit means being positioned above said anchoring means and being pivotal between a first position substantially adjacent said watch case secured by said anchoring means and a second position away from said watch case secured by said anchoring means; said opener unit means including an opener blade and twisting means for twisting said opener blade relative to said watch case, said opener unit means including a block, said block being rotatably mounted on said base and said twisting means including a twisting lever, said opener blade being supported by said block and said twisting lever, the opener blade moving with said twisting lever and said twisting lever being movable between a first position substantially parallel to a top surface of said block and a second position at an angle to said block causing said opener blade to twist to said angle, and biasing means for biasing said twisting lever into said first position.

15. A watch case back opener comprising:

a base:

adjustable securing means mounted on said base adapted to secure a plurality of different sized and shaped watch cases to said base; and opener unit means mounted on said base for separating a watch case back from said watch case, the opener unit means pivoting between first position adjacent the adjustable securing means to a second position away from said adjustable securing means and including an opener blade and twisting means for twisting said opener blade relative to said base, said opener unit means including a block pivotal mounted on said base, and said twisting means being mounted on said block, said twisting means twisting between a first position substantially parallel to an upper surface of said block and a second position angled relative to said upper surface of said block and biasing means for biasing said twisting means into said first position.

16. The watch case back opener of claim 15, wherein said adjustable securing means includes a plurality of holes formed in said watch case back opener and a plurality of posts, each post adapted to be received by any one of said plurality of holes.

17. The watch case back opener of claim 15, wherein said adjustable securing means is rotatably mounted on the base.

18. The watch case back opener of claim 16, further comprising locking means for selectively locking said securing means to prevent rotation thereof relative to the base.

19. The watch case back opener of claim 15, further comprising vise means mounted on said base, said vice means including a first jaw and a second jaw, the second jaw being movable between a closed position with said first jaw and an open position away from said first jaw, said adjustable securing means being mounted on said first and second jaw.

20. A watch case back opener comprising:

a base;

vise means mounted thereon for releasably securing a watch case to said base in prescribed orientation; said vise means comprising a companion pair of jaws relatively movable between open and closed positions for clamping a watch case therebetween; and an opener unit mounted on said base and adjustably movable in relation to the clamped watch case for separating the watch case back from the clamped watch case.

* * * * *